United States Patent [19]

Karlberger

[11] 3,972,402

[45] Aug. 3, 1976

[54] DEVICE FOR BRAKING ROLLED STOCK

[75] Inventor: Walter Johann Karlberger, Smedjebacken, Sweden

[73] Assignee: Morgardshammar Aktiebolag, Smedjebacken, Sweden

[22] Filed: Feb. 19, 1975

[21] Appl. No.: 551,058

[30] Foreign Application Priority Data

Feb. 19, 1974 Sweden ..... 7402164

[52] U.S. Cl. ..... 193/35 A; 198/34

[51] Int. Cl.[2] ..... B65G 13/00

[58] Field of Search ..... 193/35 A, 35 R, 40, 193/32; 214/1 P; 198/34

[56] References Cited

UNITED STATES PATENTS

| | | | |
|---|---|---|---|
| 1,310,231 | 7/1919 | Ahlen et al. | 198/21 |
| 3,086,637 | 4/1963 | Graef | 193/35 A X |
| 3,312,320 | 4/1967 | Froio | 193/35 A |
| 3,785,467 | 1/1974 | Takashima | 193/35 A |

FOREIGN PATENTS OR APPLICATIONS

| | | |
|---|---|---|
| 1,064,910 | 9/1959 | Germany |
| 367,933 | 6/1974 | Sweden |

*Primary Examiner*—Evon C. Blunk
*Assistant Examiner*—James L. Rowland

[57] ABSTRACT

A device for braking rolled stock on a delivery table which has a plurality of spaced rollers for receiving the stock. The device comprises brake plates located between respective rollers and movable to a position to at least in part support the stock thereon. A plurality of brake flaps are movable into position above the brake plates and the brake flaps engage the stock while supported on the brake plates to apply a braking force thereto. The brake flaps are associated with means for adjusting the braking force applied to the stock.

4 Claims, 2 Drawing Figures

DEVICE FOR BRAKING ROLLED STOCK

This invention relates to a device for braking rolled stock on a delivery roller table with brake plates capable of being lifted and lowered between the rollers in the roller table.

Normal round merchant iron (for example reinforcement steel and other bar material) is rolled with high final speed = 15 to 20 m/s for small finished dimension ($\phi$ 10mm) and with relatively low final speed = 5 to 10 m/s for greater finished dimension ($\phi$ 30mm). In a certain finishing roll stand, thus, the speeds may vary, depending on the dimension being rolled.

During rolling, the finished product is cut to pieces of suitable length in a flying shear. A rolled material yields a certain number of such pieces, according to the weight of the material in question and the final dimension of the pieces.

The cut pieces are discharged to the side onto a cooling bed where they, thus, form a mat, which is moved by steps in a lateral direction to the delivery end.

Before the bars can be moved over onto the cooling bed, however, they must be brought to a standstill. Heretofore, their braking was effected in such a manner that the bars were passed down into a long chute formed by the brake plates and lateral guides of the delivery roller table. The bars gradually were brought to a standstill, due to their friction of engagement with their support. The braking distance depends on the rolling speed in the last roll stand (final speed) and on the frictional properties of the rolled stock and support.

The cooling bed plus delivery roller table, therefore, must be constructed with such a length that the arrangement covers the longest braking distances which may occur. The over-all lengths are at present 100 to 150m, and they will substantially increase in view of the increasingly higher final speeds to be applied in future mills.

One method of reducing the over-all length after the finishing stand is to apply in some way additional braking force to the rolled stock.

This additional braking force must be capable of being controlled so that the rolled stock is stopped within the cooling bed range irrespective of the final speed and the prevailing friction coefficient.

Further, the braking device must operate fully reliably as otherwise operation troubles may occur.

The aforesaid disadvantages can be eliminated and the aforesaid desiderata be realized by utilizing a plurality of brake flaps which are movably suspended above the liftable and lowerable brake plates, and which brake flaps are provided with means, which adjustably apply a braking force to the rolled stock when the brake plates are lifted above the roller tops.

According to a preferred embodiment of the invention, the brake flaps are so balanced that the rolled stock is clamped between the brake flaps and brake plates when the latter are in braking position.

Brake flaps, thus, are mounted only above those plates in the delivery roller table which move up above the roller tops and thereafter down again, and which thereby act as brake plates.

The invention is explained in greater detail in the following, with reference to the accompanying drawings, in which.

Figure 1:
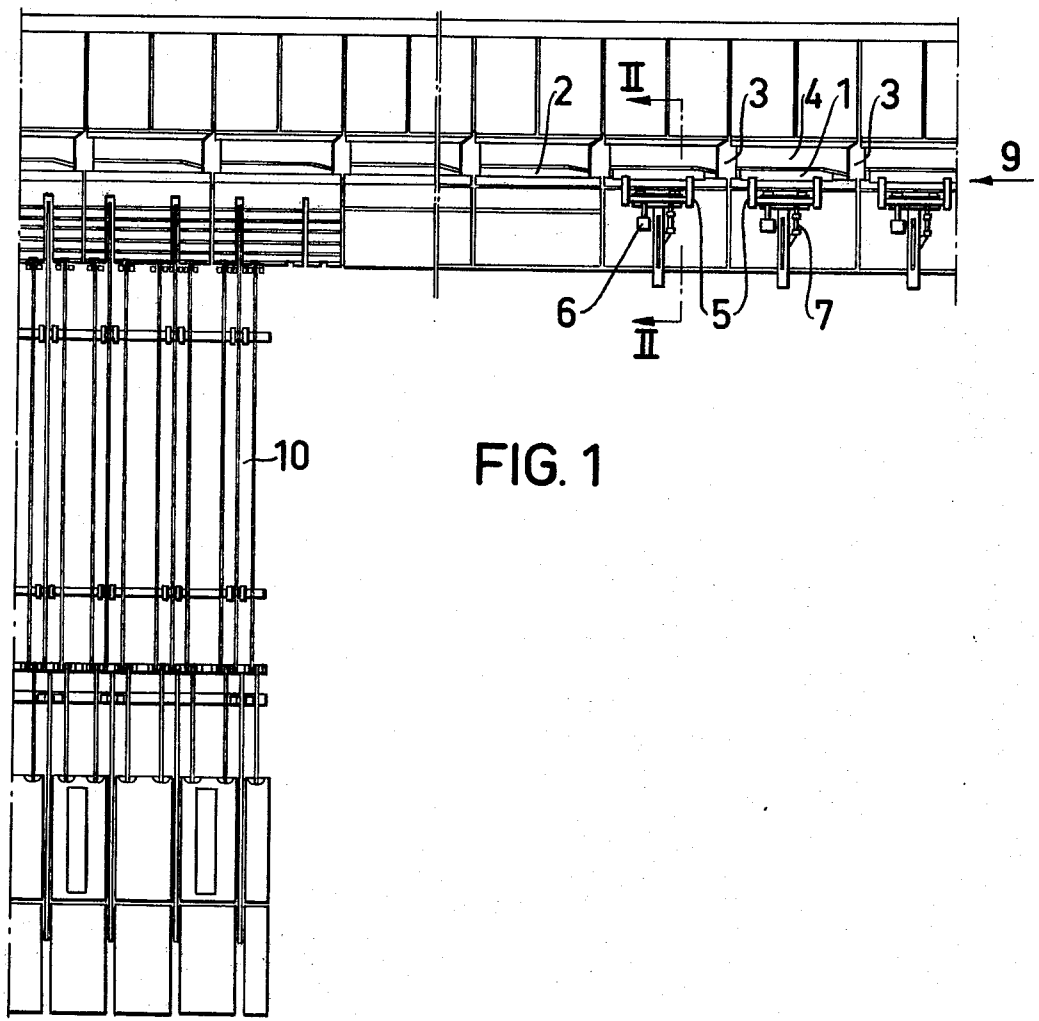
FIG. 1 is a schematic view of the invention seen from above.
Figure 2:
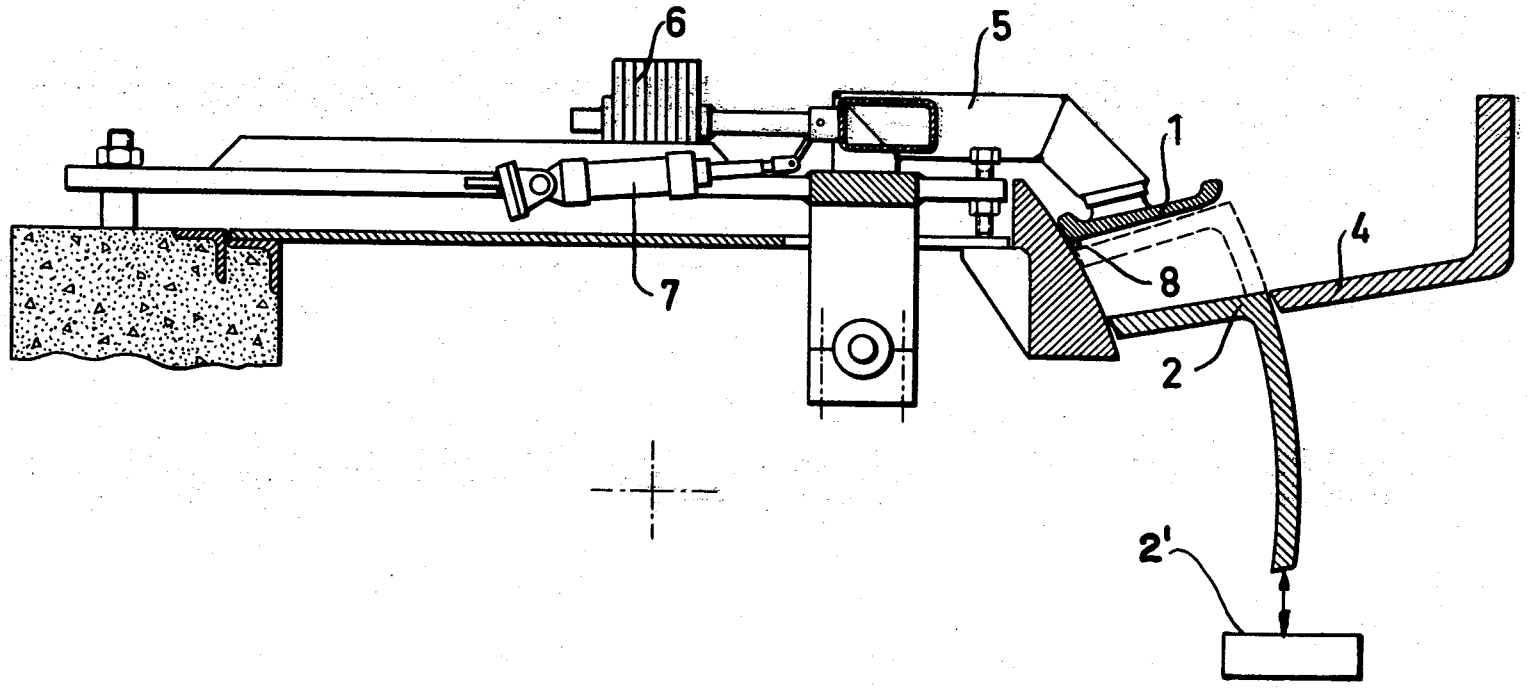
FIG. 2 is a section along the line II—II in FIG. 1.

FIG. 1 shows a part of a braking device, which in this embodiment in its entirety consists of fifteen brake flaps 1, which are mounted above the corresponding respective brake plates 2. The rolled stock 8 runs in the direction of the arrow 9 and is to be braked to a standstill so as to lie completely at rest when it is above the cooling bed 10, which, for practical reasons, is shown only partially. The rolled stock is moved in a lateral direction onto the cooling bed in a conventional manner. The liftable and lowerable brake plates 2 are mounted between the rollers 3 in the delivery roller table. Brake plates 2 are lifted and lowered by suitable means schematically represented at 2' in FIG. 2. Stationary plates 4 are also provided between the rollers and extend along the liftable and lowerable brake plates 2. The stationary plates 4 are always below the roller tops.

The brake flaps 1 are lifted or lowered by arms 5, which are pivotally supported and actuated by counterweights 6 and a hydraulic cylinder or motor 7. A suitable clamping force is in this case adjusted manually by means of the counterweights 6. The number of operative flaps is remote-controlled by a button set, for example, a button "On-Off" for each flap. The clamping force can also be imagined being adjusted in a different way, for example, pneumatically or by means of mechanical springs.

The braking device according to the invention may in a purely general way be said to consist of a number of brake flaps 1, which clamp the rolled stock when it is running out onto the brake plates 2 in the delivery roller table. The number of operative flaps 1, and their clamping force on the stock, can be varied within wide limits. The method of suspending the brake flaps and the method of applying the pressure force can be solved in different ways.

What is claimed is:

1. A device for braking rolled stock on a delivery table having a plurality of spaced rollers for receiving said stock, said device comprising brake plates located between respective rollers and movable to a position above the rollers to at least in part support the stock thereon, a plurality of brake flaps, means for supporting said brake flaps for movement into position above said brake plates, said brake flaps having a surface engageable with said rolled stock while said rolled stock is supported on said brake plates to apply a braking force thereto, and means for effecting adjustment of the braking force applied to said stock by said brake plates and brake flaps.

2. A device as defined in claim 1 wherein said means for supporting said brake flaps comprises a respective pivotally supported arm carrying a brake flap and means for pivoting said arm to position said brake flap above a brake plate.

3. A device as defined in claim 1 wherein said means for pivoting said arm comprises a hydraulic cylinder and said means for effecting adjustment of the braking force comprises counterweights associated with said pivoted arm.

4. A device as set forth in claim 1 wherein said brake flaps can be selectively actuated to vary the braking force, and including means for moving said brake flaps into braking position.

* * * * *